US009784284B2

(12) United States Patent
Hofmann et al.

(10) Patent No.: US 9,784,284 B2
(45) Date of Patent: Oct. 10, 2017

(54) STATOR ELEMENT FOR A HOLWECK PUMP STAGE, VACUUM PUMP HAVING A HOLWECK PUMP STAGE AND METHOD OF MANUFACTURING A STATOR ELEMENT FOR A HOLWECK PUMP STAGE

(71) Applicant: Pfeiffer Vacuum GmbH, Assiar (DE)

(72) Inventors: Jan Hofmann, Gruenberg (DE); Mirko Mekota, Ehringshausen (DE)

(73) Assignee: PFEIFFER VACCUM GMBH, Asslar (DE)

( * ) Notice: Subject to any disclaimer, the term of this patent is extended or adjusted under 35 U.S.C. 154(b) by 574 days.

(21) Appl. No.: 14/258,091

(22) Filed: Apr. 22, 2014

(65) Prior Publication Data

US 2014/0314554 A1 Oct. 23, 2014

(30) Foreign Application Priority Data

Apr. 22, 2013 (DE) ..... 10 2013 207 269

(51) Int. Cl.
*F04D 29/52* (2006.01)
*F04D 29/64* (2006.01)
*F04D 19/04* (2006.01)

(52) U.S. Cl.
CPC ..... *F04D 29/522* (2013.01); *F04D 19/044* (2013.01); *F04D 29/644* (2013.01); *Y10T 29/49323* (2015.01)

(58) Field of Classification Search
CPC .... F04D 29/522; F04D 29/644; F04D 19/044; Y10T 29/49323
USPC ..... 415/90, 182.1; 29/889.22
See application file for complete search history.

(56) References Cited

U.S. PATENT DOCUMENTS 5,425,264 A * 6/1995 Grenci ..... F16L 41/03 422/936
5,772,395 A 6/1998 Schofield
5,893,702 A 4/1999 Conrad
6,627,837 B1 9/2003 Carboneri
(Continued)

FOREIGN PATENT DOCUMENTS

DE 22 186 15 10/1973
DE 196 32 375 A1 2/1998
(Continued)

OTHER PUBLICATIONS

Search Report issued by the German Patent Office in the Priority German Application DE 10 2013 207 269.4, with Translation English.

*Primary Examiner* — Hoang Nguyen
(74) *Attorney, Agent, or Firm* — Abelman, Frayne & Schwab

(57) ABSTRACT

A stator element for a Holweck pump stage has a base shape of substantially cylinder jacket shape or a kit of parts for a stator element for a Holweck pump stage which has a base shape of a substantially cylinder jacket shape, wherein the stator element or the kit of parts comprises a plurality of stator parts which are separate from one another, which are assembled to form the stator element or can be assembled to form the stator element. A vacuum pump having a Holweck pump stage as well as to a method of manufacturing a stator element for a Holweck pump stage or of manufacturing a kit of parts for a stator element for a Holweck pump stage are also disclosed.

15 Claims, 1 Drawing Sheet

(56) References Cited

U.S. PATENT DOCUMENTS

| | | | | |
|---|---|---|---|---|
| 8,206,081 | B2 | 6/2012 | Stones | |
| 8,662,841 | B2 | 3/2014 | Tollner | |
| 2003/0000772 | A1* | 1/2003 | Stones | F04D 23/008 184/6.18 |
| 2003/0086784 | A1 | 5/2003 | Stuart | |
| 2004/0228747 | A1* | 11/2004 | Desbiolles | F04D 27/00 417/423.4 |
| 2004/0247428 | A1 | 12/2004 | Gotta | |
| 2005/0220606 | A1* | 10/2005 | Beyer | F04D 29/324 415/90 |
| 2006/0140795 | A1* | 6/2006 | Schofield | F04D 19/046 417/423.4 |
| 2007/0071992 | A1 | 3/2007 | Okoroafor | |
| 2013/0045094 | A1 | 2/2013 | Giors | |

FOREIGN PATENT DOCUMENTS

| | | | |
|---|---|---|---|
| DE | 10 2008 063 131 | | 7/2010 |
| DE | 10 2011 054607 | A1 | 6/2012 |
| DE | 10 2011 119 | A1 | 5/2013 |
| EP | 2549115 | | 1/2013 |
| JP | S57165695 | | 10/1982 |
| JP | H0655642 | | 3/1994 |
| JP | H08290465 | | 11/1996 |
| WO | 2011 070856 | | 6/2011 |

* cited by examiner

STATOR ELEMENT FOR A HOLWECK PUMP STAGE, VACUUM PUMP HAVING A HOLWECK PUMP STAGE AND METHOD OF MANUFACTURING A STATOR ELEMENT FOR A HOLWECK PUMP STAGE

BACKGROUND OF THE INVENTION

1. Field of the Invention

The present invention relates to a stator element for a Holweck pump stage, to a vacuum pump having a Holweck pump stage and to a method of manufacturing a stator element for a Holweck pump stage.

2. Description of the Prior Art

Vacuum pumps are used in various areas of technology such as, for example, in semiconductor process technology to generate a vacuum required for the respective technical process in a volume to be evacuated. An important pump mechanism used in vacuum pumps is the Holweck pump mechanism which is particularly effective in the molecular flow area and is called a molecular pump mechanism. Holweck pump stages are used e.g. in turbomolecular pumps which comprise, in addition to one or more turbomolecular pumps stages, one or more Holweck pump stages connected downstream of the turbomolecular pump stages. The Holweck pump stages can pump to one another in series or in parallel.

A Holweck pump stage typically comprises a stator element of substantially cylinder jacket shape and a rotor element, likewise of substantially cylinder jacket shape, with a jacket surface of the stator element and a jacket surface of the rotor element forming the surfaces of the pump stage provided with pump activity and being disposed opposite one another while forming a narrow gap which is called a Holweck gap. As a rule, a plurality of helical webs extending in the axial direction and grooves arranged between the webs and likewise extending helically in the axial direction are formed in the jacket surface of the stator element. The oppositely disposed jacket surface of the rotor element can e.g. be smooth.

The pump effect of the Holweck pump stage is based on the fact that the gas molecules to be conveyed are driven forward within the grooves by the rotating movement of the rotor element and are thereby conveyed in the axial direction, with the webs formed between the grooves sealing the grooves and preventing or reducing an outflowing or a backflowing of the gas molecules against the pumping direction.

Since a gap dimension of the Holweck gap which is as small as possible is inter alia necessary for a high pump efficiency, the stator element must be manufactured with high precision and within tight production tolerances.

Since the stator element of the Holweck pump stage is additionally directly in communication with the conveyed gases and is exposed to high thermal and mechanical loads, the material of the stator element must be selected such that a contamination of the vacuum is precluded, a sufficient vacuum tightness is ensured and the stator element withstands the thermal and mechanical loads. To satisfy this demand, stator elements for Holweck pump stages are typically milled out of solid cylinders or out of hollow cylinders composed of a vacuum-compatible metal, which is associated with a very high time and cost effort.

An object of the invention is to provide a stator element for a Holweck pump stage which satisfies the technical vacuum demands and which can be manufactured with a reduced time effort and cost effort and to provide a method of manufacturing a stator element for a Holweck pump which can be carried out with a reduced time effort and cost effort.

SUMMARY OF THE INVENTION

The object of the invention is achieved with a stator element for a Holweck pump stage which has a basic shape of substantially cylinder jacket shape, or a kit of parts for a stator element for a Holweck pump stage which has a basic shape of substantially cylinder jacket shape and comprises a plurality of mutually separate stator parts which are or can be assembled to form the stator element.

The stator element or the base body is therefore not formed in multiple parts, but rather comprises a plurality of individual stator parts which can be assembled to form the stator element.

It was recognized within the framework of the invention that the manufacture of individual stator parts is possible much more simply than the manufacture of a single-part stator element since the problems associated with a single-part manufacture such as the undercuts resulting due to the cylinder jacket shape, the lack of access and the unfavorable machining angles are avoided and instead stator parts with an unproblematic shape are manufactured. For example, the stator parts can be manufactured simply and inexpensively, as described in the following, by molding without the demolding of the stator parts being made substantially more difficult or being impeded by any undercuts.

In accordance with an advantageous embodiment, an outer and/or an inner jacket surface of the stator element respectively form(s) a surface provided with pump activity and having a plurality of webs extending helically in an axial direction and grooves arranged between the webs and extending helically in an axial direction, with the stator parts each forming a region of a surface provided with pump activity or of surfaces provided with pump activity. The webs and grooves therefore form a Holweck thread, with a helical shape also being understood as a shape which only forms a partial revolution of a helical line. The stator element can in principle have such a surface provided with pump activity at one of the named jacket surface or at both jacket surfaces. Each surface provided with pump activity can form a Holweck pump stage with the jacket surface provided with pump activity of a rotor element rotating with respect to the stator element and likewise of substantially cylinder jacket shape.

The advantage of the invention can in particular be seen when a surface provided with pump activity and having a plurality of grooves and webs is formed at at least the inner jacket surface of the stator element since in this case the single-part manufacture of a corresponding stator element is particularly complex and/or expensive.

The individual stator parts can be assembled to form the stator element and can in this respect be substantially disk shaped. At least one stator part or each stator part can in this respect form a section of the basic shape of substantially cylinder jacket shape of the stator element. At least one stator part or each stator part preferably has an outer side which forms a section of the outer jacket surface of the stator element and an inner side which forms a section of the inner jacket surface of the stator element.

Each stator part can have one or more of the above-described helical webs and helical grooves extending between them or at least sections thereof at an outer side and/or at an inner side which form(s) a part of the respective outer or inner jacket surface of the stator element.

In accordance with an embodiment, at least one stator part and in particular each stator part only covers a part region of the peripheral angle of the stator element defined relative to the longitudinal axis of the stator element. The stator element can in this respect be divided by the stator parts into a plurality of angular sections or segments following one another in the peripheral direction. A closed geometrical shape of the individual stator parts is thereby avoided, whereby its manufacture is simplified and, for example on a manufacture by molding, a simplified demolding capability of the stator parts is ensured. The stator element assembled from the stator parts preferably has a peripheral angle of 360° overall, i.e. the stator element can be formed as closed in ring shape about its longitudinal axis and can cover the full angular range defined relative to its longitudinal axis. At least one stator part or each stator part can extend over the total longitudinal extent of the stator element with respect to the longitudinal axial direction of the stator element.

At least one stator part and in particular each stator part preferably covers a range of at most 180° and preferably of less than 180° of the peripheral angle of the stator element defined relative to the longitudinal axis of the stator element. An even simpler manufacturing capability and in particular an even easier demolding capability of the stator parts can thereby be achieved on their manufacture since, with an angle of less than 180°, undercuts of the molded stator part are avoided which would prevent a demolding or make it substantially more difficult.

The stator element is preferably divided by two mutually adjacent stator parts in parallel to the longitudinal axis of the stator element and/or obliquely to the longitudinal axis of the stator element. In this respect, the two adjacent stator parts can have mutually oppositely disposed and mutually facing separating surfaces which extend through the stator element in the longitudinal direction of the stator element, and indeed at least regionally in parallel and/or obliquely to the longitudinal axis of the stator element. It is thereby made possible to build up the stator element from a relatively small number of stator parts which each only cover a part region of the peripheral angle of the stator element.

A further embodiment provides that a surface of the stator element provided with pump activity is divided by two mutually adjacent stator parts in parallel to the longitudinal axis of the stator element and/or obliquely to the longitudinal axis of the stator element. In this respect, the two adjacent stator parts have mutually oppositely disposed and mutually facing separating surfaces which extend through the surface of the stator element provided with pump activity in the longitudinal axial direction of the stator element and which define a separating line of the surface provided with pump activity which extends at least regionally in parallel and/or obliquely to the longitudinal axis of the stator element.

At least one section of a surface of the stator element provided with pump activity is preferably divided by two mutually adjacent stator parts along a groove or along a web of the surface provided with pump activity and in particular at least approximately in parallel to the groove or to the web. A separating line of the surface provided with pump activity defined by the adjacent stator parts therefore extends along a web or along a groove and in particular substantially in parallel to the web or to the groove. The manufacture of the individual stator parts is thereby simplified since the number of the webs and grooves or web sections and groove sections to be formed in each stator part is kept small. The groove base of at least one longitudinal section of the groove can, for example, be completely formed by the one stator part and a web section bounding the longitudinal section of the groove can be completely formed by the adjacent stator part so that the stator element is divided along the margin of the base of the groove. In this embodiment, slight deviations of the relative positions of the stator parts with respect to their desired position do not result in an offset of the grooves and web sections with respect to one another which impairs the pump action.

In accordance with an advantageous embodiment, at least one stator element and in particular each stator part is formed such that a plurality of stator parts identical to the stator part can be assembled to form the stator element. The manufacture of the stator elements is thereby made even simpler since no different stator elements have to be manufactured, but the stator element can rather be assembled from identical stator parts. The stator element accordingly preferably comprises at least two substantially identical stator parts and can in particular completely comprise substantially identical stator parts.

In accordance with an embodiment whose advantages can also be seen from the following description relating to a manufacturing process, at least one stator part and in particular each stator part is manufactured or can be manufactured by molding. Molding represents a particularly simple and inexpensive process with which a stator element or stator part satisfying the technical vacuum demands can be manufactured.

In accordance with a further embodiment, at least one stator part and in particular each stator part is manufactured or can be manufactured at least in part and in particular completely from a plastic. A further embodiment provides that at least one stator part and in particular each stator part is manufactured or can be manufactured by blow molding or by three-dimensional printing.

The shape of the webs of a stator part is preferably adapted such that the stator part does not have any undercuts which would prevent a demolding of the stator part or would make it substantially more difficult, e.g. when the stator part is manufactured by molding.

At least one stator part or each stator part can in principle comprise a metal, in particular a moldable metal, at least in part and in particular completely, which satisfies the respective technical vacuum demands.

In principle, the stator element can be divided into any desired number of stator parts. For example, exactly two stator parts can be provided which can each be designed substantially in the form of half-shells and can be assembled to form the stator element. Three, four, five, six or more stator parts can, however, also be manufactured which produce the stator element when assembled.

Within the framework of the present description, the fact that the stator parts can be assembled to form the stator element is understood such that the stator parts can be positioned relative to one another such that they form the stator element having the described shape. The stator parts can be configured in this respect such that they mutually maintain their desired relative positioning in the assembled state. For this purpose, the stator parts can have mutually complementary surfaces which contact one another and support one another in the assembled stator element. The assembled stator element can in this respect form a self-supporting mechanical structure. The stator parts can also be configured such that, when they are inserted into a vacuum pump for forming the stator element, they are fixed with respect to one another in their desired relative positioning and thus together form a self-supporting structure with the vacuum pump.

The stator parts can in principle be present as individual parts not connected to one another or can be connected fixedly to one another, in particular adhesively bonded to one another, and in particular with material continuity, for forming the stator element. "Mutually separate" stator parts are to be understood in the case of a fixed connection as stator parts which are manufactured or can be manufactured as individual parts and which can be subsequently connected to one another.

A basic shape of substantially cylinder jacket shape is any desired jacket shape having a preferably substantially rotationally symmetrical inner contour and/or outer contour. The basic shape can in this respect be formed by a straight cylinder jacket shape or also by a frustroconical jacket shape that is by the shape of a cylinder jacket converging or diverging in its longitudinal axial direction.

A further subject of the invention is a method of manufacturing a stator element for a Holweck pump stage which has a basic shape of substantially cylinder jacket shape or of manufacturing a kit of parts for a stator element for a Holweck pump stage which has a basic shape of substantially cylinder jacket shape. The method comprises a plurality of stator parts being manufactured separately from one another, with the stator parts being able to be assembled to form the stator element or to form a base body for the stator element. The method preferably serves for the manufacture of a stator element or of a kit of parts in accordance with the invention and in accordance with the above description. The advantageous embodiments and advantages described above with respect to the stator element and to the kit of parts and to their manufacture represent corresponding advantageous embodiments and advantages of the method.

An advantageous further development of the method provides that initially a respective base body for the stator pat is manufactured for manufacturing at least one stator part and in particular for manufacturing each stator part, with the base body subsequently being post-machined to form the stator part. The base body can in this respect be manufactured by a primary molding process and/or the base body can be post-machined by a shaping process to form the stator part. A stator element can be manufactured having a sufficient geometrical precision reliably and with a small effort in this manner. As described below, in particular molding, blow molding and three-dimensional printing (3D printing) can be considered as the primary molding processes. In principle, at least one stator part can also be manufactured completely by a primary molding process without post-machining.

The stator parts can be provided as individual parts or can be fixedly connected to one another, in particular adhesively bonded to one another, in particular with material continuity, to form the stator element.

A base body for a stator element or for a stator part is to be understood as a body which can be further processed to form the stator element or stator part. The base body for the stator element is preferably of substantially cylinder jacket shape. If reference is made in the following to the manufacture of the stator element or to the stator element itself or to the manufacture of a stator part or to a stator part itself, the corresponding description relates, where applicable and where not otherwise stated, in a corresponding manner to the manufacture of a base body for the stator element or for the stator part or for the base body itself.

If first a base body for the stator part is manufactured in a primary mold process, this base body preferably has an outer side which forms a section of an outer jacket surface of a base body of substantially cylinder jacket shape for the stator element and/or has an inner side which forms a section of an inner jacket surface of a base body of substantially cylinder jacket shape for the stator element The outer side and/or the inner side of the base body for the stator part can in this respect already have a profiling with provisional webs or web sections and grooves or groove sections arranged therebetween which are shaped by post-machining to form the final webs or web sections and grooves or groove sections arranged therebetween. The post-machining can, for example, comprise the adaptation of the shape of the provisional webs or web sections of the base body of the stator part. The post-machining can also serve to bring an outer diameter and/or inner diameter of the outer or inner jacket surface of the stator element predefined by the respective stator part even more precisely to a predefined value and thereby to make possible the narrow gap dimensions of the Holweck pump stage required for a high pump efficiency. For this purpose, e.g. existing provisional webs or web sections can be post-machined by a material-removing process, in particular a cutting process, to achieve the respective desired outer diameter or inner diameter. This post-machining can, for example, comprise a final turning of the base body for the stator part.

The shape of the web of a stator part is preferably adapted so that the stator part does not have any undercuts which would prevent a demolding of the stator part or of the base body for the stator part or which would make it more difficult e.g. when the stator part or the base body is manufactured by molding. The finished stator element can then either have such web shapes optionally differing from known web shapes or the web shape can be subsequently changed as described above.

In accordance with an advantageous embodiment, the manufacture of at least one stator part and in particular the manufacture of each stator part comprises the stator part or a base body for the stator being manufactured by molding. Molding therefore represents a possible primary molding process in the sense of the above description. Molding allows a time-efficient and cost-efficient mass production of the stator parts, whereby the time effort and cost effort required for the manufacture of a stator element is substantially reduced. In this respect, as simple demolding of the stator parts after the molding is made possible by the division of the stator element into a plurality of stator parts since deforming problems associated with the base shape of the stator element of cylinder jacket shape are avoided. As described above, at least one stator part or each stator part can have a geometry substantially free of undercuts to allow a problem-free demolding of the manufactured stator part.

A further embodiment provides that at least one stator part and in particular each stator part is manufactured at least in part and in particular completely from a plastic. It was recognized within the framework of the invention that plastic represents a material suitable for a stator element which satisfies the technical vacuum demands and which is at the same time available at less expense and can be processed more easily than conventional materials. The manufacture of the stator parts is in this respect additionally facilitated by the division of the stator element into a plurality of stator parts.

In accordance with an embodiment, the manufacture of at least one stator part and in particular the manufacture of each stator part comprises the stator part or a base body for the stator part being manufactured by blow molding or by three-dimensional printing. Blow molding or three-dimensional printing therefore represents a possible primary molding process in the sense of the preceding description. This method is particularly suitable to manufacture a stator part having a desired shape which preferably comprises a plastic at least in part and in particular in full. It was recognized within the framework of the invention that blow molding and three-dimensional printing are suitable to provide stator parts having sufficient geometrical precision which satisfy the existing technical vacuum demands.

A further subject matter of the invention is a method of manufacturing a stator element for a Holweck pump stage or of manufacturing a kit of parts for a stator element for a Holweck pump stage comprising a plurality of stator parts, the method comprising the stator element or at least one stator part or a base body for the stator element or for the stator part being manufactured by molding. It was recognized within the framework of the invention that a stator element or a stator part or a base body can be manufactured with the technical vacuum properties required for the use in a Holweck pump stage by this manufacturing method which can be carried out with a reduced time effort and cost effort.

An outer jacket surface and/or an inner jacket surface of the stator element preferably respectively forms a surface provided with pump activity and having a Holweck thread, i.e. having a plurality of webs extending helically in an axial direction and grooves arranged between the webs and extending helically in an axial direction. The method can comprise a base body for the stator element or for a stator part for the stator element first being manufactured by molding, said base body subsequently being post-machined for forming the stator element or stator part, in particular by a shaping process. A base body for a stator element manufactured by molding preferably has a base shape of substantially cylinder jacket shape. The base body can also already have one or more provisional webs and/or grooves at its inner side and/or outer side. A post-machining can then comprise an adaptation of the web shape and/or an adaptation of the outer diameter and/or of the inner diameter of the stator element predefined by the base body.

A further subject matter of the invention is a method for manufacturing a stator element for a Holweck pump stage or for manufacturing a kit of parts for a stator element for a Holweck pump stage comprising a plurality of stator parts, the method comprising the stator element or at least one stator part or a base body for the stator element or for the stator part being manufactured from a plastic at least in part and in particular in full. It was recognized within the framework of the invention that a stator element can be manufactured from a plastic which is available inexpensively and can be processed simply and inexpensively, said stator element having the technical vacuum properties required for the use in a Holweck pump stage. An outer jacket surface and/or an inner jacket surface of the stator element preferably forms/form in this respect a respective surface provided with pump activity and having a Holweck thread, i.e. having a plurality of webs extending helically in an axial direction and grooves arranged between the webs and extending helically in an axial direction.

A further subject matter of the invention is a method of manufacturing a stator element for a Holweck pump stage or of manufacturing a kit of parts for a stator element for a Holweck pump stage comprising a plurality of stator parts, the method comprising the stator element or at least one stator part or a base body for the stator element or for the stator part being manufactured by blow molding or three-dimensional printing. It was recognized within the framework of the invention that a stator element or a stator part can be manufactured by blow molding or by three-dimensional printing which can be carried out with a small effort and/or costs, said stator element or stator part having the technical vacuum requirements required for the use in a Holweck pump stage. The stator element or stator part in this respect preferably comprises a plastic at least in part and in particular in full. An outer jacket surface and/or an inner jacket surface of the stator element preferably respectively forms a surface provided with pump activity and having a Holweck thread, i.e. having a plurality of webs extending helically in an axial direction and grooves arranged between the webs and extending helically in an axial direction.

A subject matter of the invention is furthermore a stator element for a Holweck pump stage and/or a kit of parts for a stator element for a Holweck pump stage, wherein the stator element or the kit of parts is or can be manufactured by a method in accordance with the above description. Such a stator element satisfies the technical vacuum demands existing for the use in a Holweck pump stage and can simultaneously be manufactured with a small time effort and cost effort. The advantageous embodiments and advantages of the stator element or of the kit of parts described above in relation to the manufacturing method represent corresponding advantageous embodiments and advantages of the stator element or kit of parts in accordance with the invention.

A subject matter of the invention is furthermore a vacuum pump having at least one Holweck pump stage which comprises at least one stator element in accordance with the present description. The advantageous embodiments described above with respect to the stator element and its use in a vacuum pump represents advantages and advantageous embodiments of the vacuum pump on a corresponding use. The stator element can form the at least one Holweck pump stage of the vacuum pump together with at least one rotor element. In this respect, a surface of the stator element provided with pump activity or a surface of the rotor element provided with pump activity can lie opposite one another and can define a radial Holweck gap with this surface. The vacuum pump can in particular be configured as a turbomolecular pump which comprises one or more turbomolecular pump stages which can in particular be arranged upstream of the one or more Holweck pump stages and can be connected in series with them in a technical flow aspect. The Holweck pump stages can in this respect in principle pump in parallel or in series with one another. The time effort and cost effort for the manufacture of the vacuum pump is substantially reduced by the use of the stator element in accordance with the invention.

BRIEF DESCRIPTION OF THE DRAWINGS

The invention will be described in the following by way of example with reference to advantageous embodiments and to the enclosed drawings. There are shown.

DETAILED DESCRIPTION OF THE PREFERRED EMBODIMENTS

Figure 1:
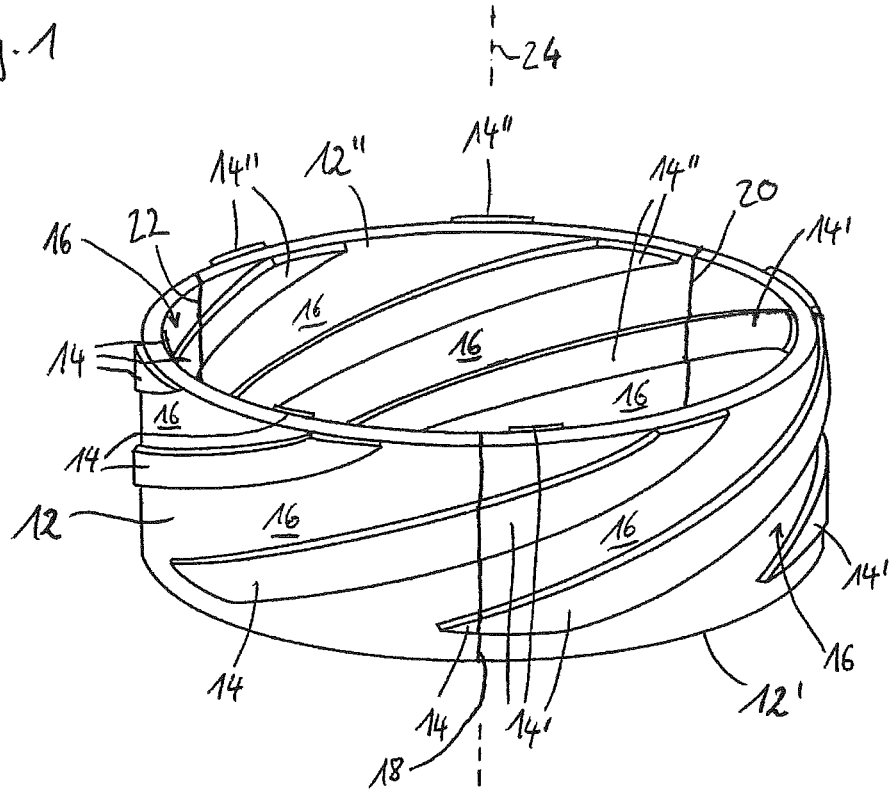
FIG. 1 a perspective view of a stator element in accordance with an embodiment of the invention.

FIG. 1 shows a stator element in accordance with an embodiment of the invention in the assembled state. The stator element has a base shape of substantially cylinder jacket shape and comprises three separate stator parts 12, 12', 12" which divide the stator element into three angular sections. The separating surfaces between the individual stator parts 12, 12', 12" are marked by the reference numerals 18, 20, 22 in FIG. 1 and extend substantially in parallel to the longitudinal axis 24 of the stator element so that each stator part 12, 12', 12" forms a cylinder jacket segment having a substantially rectangular contour shape viewed from its flat side.

Each stator part 12, 12', 12" comprises a respective plurality of web sections 14, 14', 14" both at its outer side and at its inner side, said web sections together forming webs which extend helically in the direction of the longitudinal axis 24, which are arranged at the inner jacket surface and at the outer jacket surface of the stator element and between which grooves 16 are formed which respectively extend helically in the direction of the longitudinal axis 24. The webs and grooves 16 in this respect each form a Holweck thread at the inner jacket surface and at the outer jacket surface of the stator element which is suitable to form a Holweck pump stage with a rotor element rotating with respect to the respective jacket surface and formed as a Holweck cylinder, with the rotor element in particular being able to have a smooth surface provided with pump activity. Due to the segmentation of the stator element, its manufacture is considerably simplified since the individual stator parts 12, 12', 12" can be manufactured, for example, by molding substantially free of undercuts and can thus be simply demolded.

Figure 2:
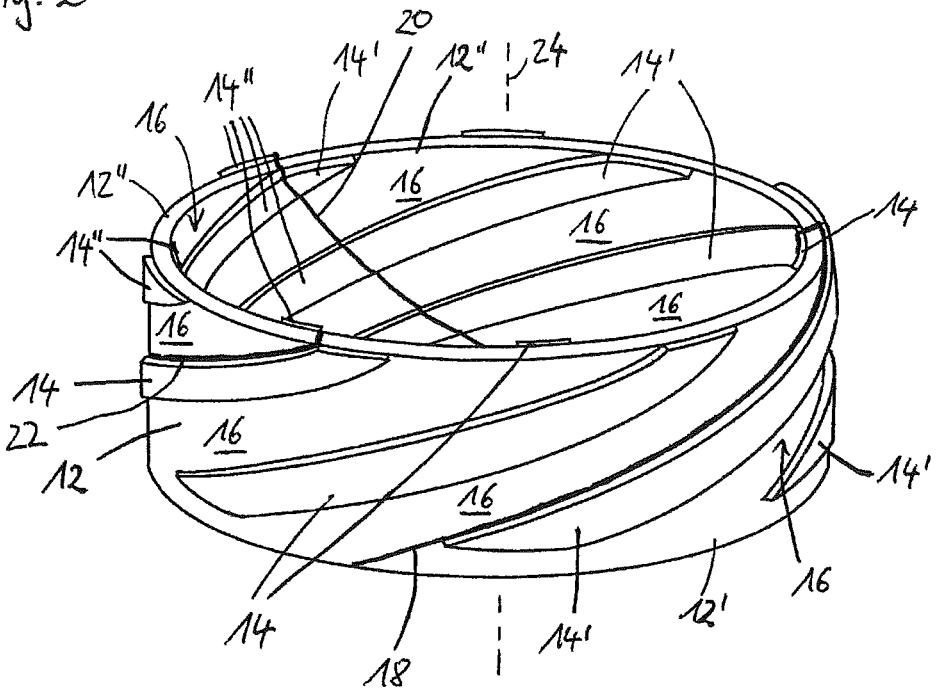
FIG. 2 a perspective view of a stator element in accordance with an embodiment of the invention.

FIG. 2 shows a stator element in accordance with a further embodiment of the invention which substantially corresponds to the stator element shown in FIG. 1 and which only differs by the geometry of the division of the stator element into stator parts 12, 12', 12". The stator element is divided by the three stator parts 12, 12', 12" transversely to the longitudinal axis 24 so that each stator part 12, 12', 12" forms a cylinder jacket segment having a substantially diamond-shaped contour shape viewed from its flat side. The separating surfaces 18, 20, 22 each extend along the margin of a base of a groove 16 arranged at the outer jacket surface of the stator element so that the respective groove base and the respective adjacent web 14, 14', 14" are not interrupted by the separating surfaces 18, 20, 22 at the outer jacket surface.

What is claimed is:

1. A stator element for a Holweck pump stage which has a base shape of substantially cylinder jacket shape, wherein the stator element comprises a plurality of mutually separate stator parts (12, 12', 12") which are assembled to form the stator element or which can be assembled to form the stator element, and wherein each of the plurality of separate stator parts (12, 12', 12") only covers a part region of a peripheral angle of the stator element defined relative to a longitudinal axis (24) of the stator element, and each of the separate stator parts (12, 12', 12") has a plurality of web sections (14, 14', 14"), wherein a surface of the stator element provided with pump activity is divided by two mutually adjacent stator parts (12, 12' and 12") parallel to the longitudinal axis (24) of the stator element and/or obliquely to the longitudinal axis of the stator element, the two mutually adjacent stator parts (12, 12', 12") have mutually disposed and facing each other separating surfaces (18, 20, 22) extending through the surface of the stator element.

2. The stator element in accordance with claim 1, wherein at an outer jacket surface and an inner jacket surface of each stator part forms a surface provided with pump activity, and the plurality of web sections is provided on both the outer and inner jacket surfaces, extend helically in an axial direction and have grooves (16) arranged between the web sections (14, 14', 14"), the grooves extending helically in an axial direction, and wherein the stator parts (12, 12', 12") each forming one of a region of the surface provided with pump activity and the surfaces provided with pump activity.

3. The stator element in accordance with claim 1, wherein each stator part (12, 12', 12") covers a range of less than or equal to 180° of the peripheral angle of the stator element defined relative to a longitudinal axis (24) of the stator element.

4. The stator element in accordance with claim 1, wherein at least one section of a surface of the stator element provided with pump activity is divided by two mutually adjacent stator parts (12, 12', 12") along one of a groove (16) and a web (14, 14', 14") of the surface provided with pump activity.

5. The stator element in accordance with claim 1, wherein each stator part (12, 12', 12") is configured such that a plurality of stator parts (12, 12', 12") identical to the stator part (12, 12', 12") can be assembled to form the stator element.

6. The stator element in accordance with claim 1, wherein the stator element is assembled from a kit of parts which comprises the plurality of mutually separate stator parts (12, 12', 12") which can be assembled to form the stator element.

7. A method of manufacturing a stator element for a Holweck pump stage which has a base shape of substantially cylinder jacket shape, the method comprising the steps of manufacturing a plurality of separate stator parts (12, 12', 12") which form together a stator element, with each stator part having a plurality of web sections (14, 14', 14"), and assembling the stator parts (12, 12', 12") from a kit of stator parts to form the stator element, so that each of the plurality of stator parts only covers a part region of a peripheral angle of the stator element defined relative to a longitudinal axis of the stator element, wherein assembling of the stator element is so carried out that a surface of the stator element provided with pump activity is divided by two mutually adjacent stator parts (12, 12' and 12") parallel to the longitudinal axis (24) of the stator element and/or obliquely to the longitudinal axis of the stator element, with mutually disposed and facing surfaces (18, 20, 22) of the two mutually adjacent stator parts (12, 12', 12") extending through the surface of the stator element.

8. The method in accordance with claim 7, further comprising the step of first manufacturing a base body for the stator part (12, 12', 12"), and subsequently post-machining the base body to form the stator part (12, 12', 12").

9. The method in accordance with claim 8, wherein the step of manufacturing the base body is carried out by a primary molding process.

10. The method in accordance with claim 8, wherein the step of post-machining the base body is carried out by a shaping process.

11. The method in accordance with claim 7, wherein the step of manufacturing the plurality of stator parts (12, 12', 12") comprises the step of manufacturing each stator part (12, 12', 12') by molding.

12. The method in accordance with claim 7, wherein the each stator part (12, 12', 12") is manufactured from a plastic at least in part.

13. The method in accordance with claim 7, wherein the step of manufacturing the each stator part (12, 12', 12")

comprises the step of manufacturing the stator part (12, 12', 12") by blow molding or by three-dimensional printing.

14. A method according to claim 7, comprising the step of manufacturing at least one member selected from the group comprising the stator element with the plurality of stator parts (12, 12', 12"), a base body for the stator element and a base body for each stator part (12, 12', 12") by one of the following processes selected from the group comprising molding manufacturing from a plastic at least in part by blow molding and by three-dimensional printing so that each of the plurality of stator parts only covers a part region of a peripheral angle of the stator element defined relative to a longitudinal axis (24) of the stator element.

15. A vacuum pump, having at least one Holweck pump stage which comprises at least one stator element, the stator element having a base shape of substantially cylinder jacket shape, and with the stator element comprising a plurality of mutually separate stator parts (12, 12', 12") with each of the plurality of stator parts having a plurality of web sections (14, 14' 14") which are assembled to form the stator element or which can be assembled to form the stator element so that each of the plurality of the stator parts only covers a part region of a peripheral angle of the stator element relative to a longitudinal axis (24) of the stator element, wherein a surface of the stator element provided with pump activity is divided by two mutually adjacent stator parts (12, 12' and 12") parallel to the longitudinal axis (24) of the stator element and/or obliquely to the longitudinal axis of the stator element, the two mutually adjacent stator parts (12, 12', 12") have mutually disposed and facing each other separating surfaces (18, 20, 22) extending through the surface of the stator element.

* * * * *